US012594505B2

(12) United States Patent
Burger

(10) Patent No.: US 12,594,505 B2
(45) Date of Patent: Apr. 7, 2026

(54) AMUSEMENT RIDE, IN PARTICULAR WATER AMUSEMENT RIDE, AND METHOD FOR OPERATING SUCH AN AMUSEMENT RIDE

(71) Applicant: MACK RIDES GMBH & CO. KG, Waldkirch (DE)

(72) Inventor: Günter Burger, Waldkirch (DE)

(73) Assignee: MACK RIDES GMBH & CO. KG, Waldkirch (DE)

( * ) Notice: Subject to any disclaimer, the term of this patent is extended or adjusted under 35 U.S.C. 154(b) by 756 days.

(21) Appl. No.: 17/776,536

(22) PCT Filed: Jul. 30, 2020

(86) PCT No.: PCT/EP2020/071523
§ 371 (c)(1),
(2) Date: May 12, 2022

(87) PCT Pub. No.: WO2021/094005
PCT Pub. Date: May 20, 2021

(65) Prior Publication Data

US 2022/0379227 A1 Dec. 1, 2022

(30) Foreign Application Priority Data

Nov. 15, 2019 (DE) ..... 102019130956.5

(51) Int. Cl.
*A63G 3/02* (2006.01)
*A63G 31/00* (2006.01)

(52) U.S. Cl.
CPC ..... *A63G 3/02* (2013.01); *A63G 31/007* (2013.01)

(58) Field of Classification Search
CPC ..... A63G 3/02; A63G 31/007
See application file for complete search history.

(56) References Cited

U.S. PATENT DOCUMENTS 5,473,990 A 12/1995 Anderson et al.
5,732,635 A 3/1998 McKoy
(Continued)

FOREIGN PATENT DOCUMENTS

AU 2020384235 B2 * 2/2024 ..... A63G 3/00
DE 398913 A 7/1924
(Continued)

OTHER PUBLICATIONS

Extended European Search Report, in parallel European divisional application No. 24152148.3.
(Continued)

*Primary Examiner* — Jason C Smith
(74) *Attorney, Agent, or Firm* — Nath, Goldberg & Meyer; Jerald L. Meyer; Ilirian Durri

(57) ABSTRACT

The present invention relates to an amusement ride (1), in particular a water amusement ride, having at least one rail guide (10) with at least one vehicle (20), preferably at least two vehicles, which accommodate/s at least one passenger and which can travel, guided on the rail guide (10), a route (11) in a direction of travel, wherein the at least one vehicle (20) or one of the at least two vehicles (20) can be moved by an active drive (50, 60) counter to the direction of travel, at least in sections. Furthermore, the present invention relates to a method for operating such an amusement ride (1).

35 Claims, 3 Drawing Sheets

(56) References Cited

U.S. PATENT DOCUMENTS

| | | | | |
|---|---|---|---|---|
| 5,860,364 | A | 1/1999 | McKoy | |
| 6,354,223 | B2 | 3/2002 | McKoy | |
| 10,058,788 | B2 * | 8/2018 | Burger | A63G 7/00 |
| 10,099,148 | B2 * | 10/2018 | Burger | A63G 7/00 |
| 11,779,851 | B2 * | 10/2023 | Vance | A63G 31/007 472/128 |
| 2005/0090320 | A1 * | 4/2005 | Henry | A63G 21/18 472/13 |
| 2010/0160054 | A1 | 6/2010 | Henry | |
| 2012/0291657 | A1 * | 11/2012 | Nemeth | A63G 3/00 104/53 |
| 2015/0190726 | A1 * | 7/2015 | Frolov | A63G 1/02 472/61 |
| 2018/0120862 | A1 | 5/2018 | Dembinski et al. | |
| 2020/0108324 | A1 | 4/2020 | Bloomfield et al. | |
| 2020/0155953 | A1 | 5/2020 | Vance et al. | |
| 2020/0324212 | A1 * | 10/2020 | Sornik | A63G 27/00 |
| 2022/0379227 | A1 * | 12/2022 | Burger | A63G 3/00 |

FOREIGN PATENT DOCUMENTS

| | | | | |
|---|---|---|---|---|
| DE | 102004062315 | A1 | 6/2006 | |
| EP | 2505241 | A1 * | 10/2012 | A63G 3/00 |
| FR | 681822 | | 5/1930 | |
| JP | 7499796 | B2 * | 6/2024 | A63F 11/0051 |
| WO | 99/38746 | A1 | 8/1999 | |
| WO | WO-2016014243 | A1 * | 1/2016 | A63G 31/16 |
| WO | 2019/168937 | A1 | 9/2019 | |

OTHER PUBLICATIONS

Office action has been issued on Oct. 7, 2023, in parallel pending Chinese patent application No. 202080089557.0.

Youtube.de: Mack Rides: the Rocking Boat; https://www.youtube.com/watch@v=d6srd2tchaA, dated Jun. 3, 2020.

Office Action issued Sep. 10, 2020, in corresponding German application No. 10 2019 130 956.5.

Office action issued by the CPO on Mar. 7, 2025, in parallel pending Chinese patent application No. 202080078049.2.

* cited by examiner

AMUSEMENT RIDE, IN PARTICULAR WATER AMUSEMENT RIDE, AND METHOD FOR OPERATING SUCH AN AMUSEMENT RIDE

This is a National Phase Application filed under 35 U.S.C. 371 as a national stage of PCT/EP2020/071523, filed Jul. 30, 2020, an application claiming the benefit of German Application No. 10 2019 130 956.5 filed Nov. 15, 2019, the content of each of which is hereby incorporated by reference in its entirety.

The present invention relates to an amusement ride having the features of claims 1, 21, 26, 32, and 33 and to a method for operating an amusement ride having the features of claim 36 and to an effect vehicle having the features of claim 37.

Amusement rides are already known from the prior art in different designs and are provided for passengers as stationary or semi-stationary installations or attractions, in particular in amusement parks. Generic amusement rides can be water rides or roller coasters which have a rail guide for at least one vehicle that can move on the rail guide. The at least one moving vehicle can accommodate at least one passenger, with vehicles of this type typically being able to accommodate a plurality of passengers for a shared experience, in order to enable group experiences as well as individual experiences.

To give the at least one passenger a ride experience that is as realistic as possible while traveling on the amusement ride, the vehicle should be able to realistically perform natural movements that are expected of the vehicle. For example, it is desirable for a water amusement ride to convey the feeling of a boat ride that is as realistic as possible and for the vehicle to follow both water movements and movements caused by the passengers-such as rocking or the like.

Numerous water amusement rides modeled on a whitewater ride with a body of water and where the vehicle is a floating boat are already known from the prior art. Vehicles of these known water amusement rides can either be driven passively by gravity and the current in the body of water and/or actively, for example by traction means below the water surface.

In order to operate as naturally as possible, the boats can float more or less freely, although in the past tragic accidents have occurred due to the vehicle not being kept under control over the entire extent of the route. The cause of such accidents is often the vehicle tipping over or capsizing due to misbehavior on the part of the passengers.

In currently known amusement rides, it has also proven to be disadvantageous that it is only possible to a limited extent to realize throughput-optimized operation of the amusement ride together with a personalized experience.

This is where the present invention begins.

The present invention therefore addresses the object of providing an improved amusement ride, in particular an improved water amusement ride, which improves the amusement rides known from the prior art in an expedient manner, enables safe operation of an amusement ride, provides personalized experiences, and enables through-put-optimized operation.

These objects are achieved by the features of claims 1, 21, 26, 32, and 33 and by a method having the features of claim 35 and an effect vehicle for such an amusement ride having the features of claim 36.

Further advantageous embodiments of the present invention are specified in the dependent claims.

The amusement ride according to the invention, in particular the water amusement ride according to the invention, having the features of the preamble of claim 1 has a rail guide with at least one vehicle, preferably at least two vehicles, which accommodate/s at least one passenger and which can travel, guided on the rail guide, a route in a direction of travel. According to the characterizing part of claim 1, at least one section is provided along the route, in which the at least one vehicle or in which one of the at least two vehicles can be driven by an active drive counter to the direction of travel.

In the context of this invention, an amusement ride is understood to mean a stationary or semi-stationary or mobile amusement facility which is preferably used in an amusement park to amuse passengers.

Furthermore, in the context of this invention, a rail guide is understood to mean a guide system with at least one, preferably two rails, which preferably run in parallel and spaced apart from one another. The at least one vehicle can be movably supported on the rail guide via rollers or wheels, with the at least one vehicle also preferably embracing the at least one rail of the rail guide and being securely supported thereon.

Here and in the following, a further distinction is made between an active drive and a passive drive. An active drive requires an arbitrarily designed motor by means of which the vehicle can be accelerated or braked in a controlled manner. In contrast, the vehicle is driven passively by gravity or by an air or water current.

The concept underlying the amusement ride of the present invention is that the at least one vehicle can be actively driven individually along the route and thus allows the at least one passenger in the vehicle to have a personalized experience. In particular if there are at least two vehicles on the route, one of the at least two vehicles can travel counter to the direction of travel by means of the active drive, while the at least one other vehicle can travel the route in the direction of travel. The at least two vehicles can also be actively driven at a different speed at the same time. The present amusement ride thus differs substantially from the previously known amusement rides in that the vehicles can travel along the rail guide on the route in a non-uniform and therefore personalizable manner.

According to an advantageous development of the present invention, the rail guide of the route runs, at least in sections, in a body of water. According to this advantageous embodiment of the present invention, the amusement ride is consequently designed as a water amusement ride having a body of water at least in sections, it being possible for the body of water to be, for example, a whitewater stream or river with rapids and areas of still water. The rail guide is preferably arranged below a water surface in the body of water and guides the at least one vehicle through the body of water without the course of the route being immediately apparent to passengers. For this purpose, the water in the body of water can also be colored by additives that obscure the view of the rail guide under the water surface.

Furthermore, according to an advantageous development of the present invention, the route can be circulated by the at least one vehicle in the direction of travel. The route can preferably constitute a closed circular path, the closed circular path being traveled unidirectionally in a general sense in the direction of travel by the at least one vehicle in normal operation and transporting the at least one passenger from an entrance to an exit. The entrance as well as the exit can be located in a shared station. In particular, by circulating the route, vehicles can be cycled or a plurality of vehicles can be sent on the route one after the other, as a result of which the amusement ride can be designed for a continuous throughput of passengers and the capacity for throughput optimization can be further increased.

According to an aspect or a development of the invention, a-preferably inter-active-waiting area is provided in the station, in particular in the entrance area, and thus before the journey on the at least one vehicle of the amusement ride. Games, quizzes, and other competitions can be held in the interactive waiting area and the results can be evaluated. Based on the result, the seats and functions, such as the roles of the passengers during the ride, can be allocated for the journey on the amusement ride. Such a role can be, for example, the commander, gunner, helmsman, steersman, captain, or similar. It has also been shown that by predetermining seat allocation in the at least one vehicle from the front to the back, there is no physical competition for specific seats, for example in the first row, and that boarding is regulated. The waiting time for the passengers can also be made more pleasant. Alternatively or in addition, the seats or roles can be assigned by a payment function or by dividing the queue. Terminals can be handed out for the purpose of holding the competitions and/or for driving the vehicle; these are collected later, i.e., before or after the ride.

According to a development of the present invention, the body of water can flow at least in regions in the direction of travel, and the vehicle can be passively driven and taken along at least in sections by the current of the body of water. The current in the body of water can be favored by a corresponding gradient so that, in sections, the at least one vehicle is not driven on the route in a controlled manner by an active drive.

A further aspect or development of the present invention relates to a generic amusement ride, the at least one vehicle preferably comprising a rail vehicle and a buoyant boat for accommodating the at least one passenger. The buoyant boat is coupled to the rail vehicle by means of a connecting device which allows the boat to float above the rail vehicle and allows limited transverse and/or longitudinal movement of the boat relative to the rail vehicle when the boat is afloat. The buoyant boat is thus designed as a floating body that generates sufficient buoyancy to allow the boat to float freely, including an allowable capacity of at least one passenger plus a safety factor. The connecting device allows a lifting movement which enables free floating above the rail vehicle and thus the transverse and longitudinal movements typical of a boat ride are made possible by the rocking and rolling movements which largely cor-respond to a natural floating movement. The floating movements of the boat are consequently mechanically decoupled from the rail vehicle, as a result of which the feeling of a realistic boat ride is conveyed to the passenger when afloat.

According to another preferred embodiment of the present invention, the connecting device is designed in such a way that the boat, when afloat, can be moved transversely and longitudinally in an angular range of +50°, preferably +30°, relative to the rail vehicle. The connecting device consequently limits the maximum deflection or maximum inclination or heeling of the boat, as a result of which the boat is guided safely throughout the journey on the amusement ride and capsizing is impossible.

According to a preferred development of the present invention, the connecting device comprises at least one actuator which allows the boat to actively perform a transverse, longitudinal, and/or lifting movement relative to the rail vehicle. The at least one actuator can preferably be synchronized together with other effects that execute transverse, longitudinal, and/or lifting movements of the boat.

For example, along the route of the amusement ride, an animation can be presented to the passengers in the at least one vehicle via a playback apparatus, with the at least one actuator moving the boat depending on the animation. To give a specific example in this context, the animation can represent the sudden appearance of a monster in front of the vehicle or boat, with the actuator on the boat simulating waves caused by the monster. In particular, it can also be advantageous if the at least one active drive-likewise synchronized with the animation-drives the vehicle counter to the direction of travel, i.e., in other words, drives the vehicle back, as a result of which, in addition to the waves caused by the monster, the resulting current and evasive movement of the vehicle are likewise simulated. The synchronization between the effects and the at least one active drive can be carried out via a common controller of the amusement ride and via appropriate communication interfaces between the individual organs of the amusement ride.

According to a development of the present invention, the connecting device comprises articulated rods. The articulated rods connect the rail vehicle and the boat via suitable joints, always ensuring that the rail vehicle is preferably mechanically connected to the boat and thus ensuring permanent control of the boat or the location of the boat relative to the rail vehicle.

According to a development of the present invention, lockable coupling elements can be provided, by means of which the position and/or location of the boat relative to the rail vehicle can be fixed. If the route is designed appropriately, the coupling elements can firmly connect the boat to the rail vehicle in one position when the boat is lowered onto the rail vehicle and can preferably lock it fully automatically. The coupling elements can also be configured to suppress a longitudinal and/or transverse movement when the boat is afloat, in order to, for example, give anxious passengers a feeling of safety while traveling on the amusement ride. The lockable coupling elements can also reduce the angular range in which the boat can be moved transversely and/or longitudinally to larger or smaller angular ranges such as +5°, +10°, +15°, +20°, +25°, +30°, +35°, +40°, +45°, or even up to +50° to enable target-group-appropriate movement of the boat when afloat.

According to a development of the present invention, a rotational joint is provided, by means of which the boat can be rotated about a vertical axis relative to the rail vehicle. By definition, the vertical axis is the yaw axis of the rail vehicle. The rotational joint allows the boat to be turned relative to the rail vehicle, and therefore the direction of travel of the rail vehicle and the orientation of the boat can deviate from one another. In particular, it can be advantageous if the active drive causes the vehicle to travel counter to the direction of travel of the route and that the boat is oriented by turning in such a way that the passengers in their intended position look in the direction of travel. The rotational joint can also be used to orient the boat in any direction along the route so that passengers have the best possible view of an animation, performance, or other attraction along the route.

The boat is preferably oriented about the vertical axis of the rail vehicle by a control element, as a result of which the rotation of the boat relative to the rail vehicle is controlled and possibly synchronized with effects.

According to another aspect or development of the present invention, a first active drive and at least one second active drive are provided and the at least one second active drive can drive the at least one vehicle on the route independently of the first active drive. The first active drive and the at least one second active drive can be of different designs and in particular have different drive powers. For example, the first active drive can permanently drive the vehicle, while the second active drive is a power-trimmed drive that can briefly accelerate the vehicle to a high speed in a section of the route. For example, the drive power of the at least one second drive can provide multiple, in particular five times, ten times, or 15 times the drive power for the particular vehicle.

Manual drives made available to the at least one passenger can also be provided. For example, the at least one vehicle can have a pedal drive by means of which the passengers can assist the at least one active drive. Paddles, boat hooks, or similar can also be provided.

Furthermore, it has proven to be advantageous if the at least one vehicle has at least one coupling device by means of which at least one of the active drives can be coupled or decoupled. The coupling device can, for example, briefly accelerate the vehicle to a high speed, decouple the first active drive, and couple the second active drive.

The coupling device also fulfills safety-related aspects. In the event of a technical failure of the vehicle, it must be ensured that the at least one passenger accommodated by the vehicle can end the journey on the amusement ride safely and with dry feet. The coupling device can, for example, decouple all active drives, as a result of which the vehicle can move freely on the rail guide and can be "towed away" by another vehicle. The other vehicle can, for example, push the vehicle that has stopped to the exit or the station. Alternatively, in the event of a technical failure, the coupling device can switch between the drives in order to continue the journey to the exit or station.

According to a development of the present invention, the first active drive and/or the at least one second active drive can be a cable or conveyor chain drive, a gear drive, or a friction drive. If at least one of the active drives is a cable or conveyor chain drive, the coupling device can comprise one or more clamps, by means of which a coupling between the relevant vehicle and the active drive can take place.

Furthermore, the gear wheel drive or the friction wheel drive can be accomplished by a sword, by a protruding tube, or a tubular rail along the rail guide, with a driven gear wheel of the vehicle engaging a corresponding countertoothing of the sword or one or more driven friction wheels of the vehicle being operatively connected to the sword.

A combination of the different drives makes it possible to combine the ad-vantages of the individual drives and to enable all scenarios and driving situations depending on the desired driving profile of the amusement ride. For example, a cable or conveyor chain drive can be accomplished by a motor arranged outside the vehicle, making accessibility, maintenance, and operation easy and efficient. In particular, the vehicle does not need to be supplied with energy for drive purposes, which means that a complex energy supply is required, which may entail other types of impairments.

According to a development of the present invention, at least one of the active drives is fixed to the vehicle. In particular, it is preferred if at least one of the active drives is fixed in or on the rail vehicle. When the amusement ride is operated as intended, the at least one active drive in the rail vehicle remains hidden from view of the passengers and the illusion can be created for the passengers that the vehicle is being driven freely along the route by the current.

According to a development of the present invention, the vehicle is supplied with electrical energy inductively, by cable, by means of a battery or capacitors/supercapacitors, and/or by means of a wiper. Fuel cells can also be used. In particular, it has proven successful for amusement rides with a short total distance of up to 500 m if the electrical energy is supplied by cable. The cable can be kept taut in the air above the amusement ride by suitable means and ensures a continuous supply of electrical energy to the vehicle. A wiper or a so-called current collector can also be provided, which contacts at least one electrical conductor arranged in sections adjacent to the route to transmit electrical energy.

According to a preferred embodiment of the present invention, the vehicle has a mast, at the free end of which means for transmitting electrical energy are provided. In particular, it is preferred if the wiper or the cable is fastened to the free end of the mast.

In the event that the electrical energy is supplied by cable, it can be advantageous if the mast is arranged on the rail vehicle and protrudes therefrom and not from the boat. It is possible that the cable could exert an unwanted force on the mast, causing the boat to heel.

In another case, in which electrical energy is supplied via a wiper, the mast can be arranged on the boat and protrude from the boat. The mast can have dummies of nautical equipment or sails and thus conceal the actual purpose that the mast brings the wiper at the free end into contact with the at least one electrical conductor.

In particular, it has proven to be advantageous if at least one electrical conductor is arranged at least in sections over the route of the amusement ride and can be contacted by the wiper at the free end of the mast in order to transmit electrical energy. The at least one electrical conductor can be a grid structure that is arranged over the route, taking into account a possible deflection of the vehicle. Furthermore, it has proven to be advantageous that an electrical conductor is only to be provided where an active drive of the at least one vehicle is required. In sections in which the rail vehicle is driven passively in the body of water by the current or by gravity, a supply of electrical energy is therefore not absolutely necessary. Such a supply of electrical energy can also be used to charge a battery or capacitor/supercapacitor—also called caps or supercaps—of the vehicle.

According to a further advantageous embodiment of the present invention, the route has at least one section in which the vehicle emerges completely or partially from the body of water. In particular, it is advantageous if the vehicle completely or partially emerges from the body of water at the entrance and/or exit or in the station and the boat is lowered onto the rail vehicle and in this state is firmly connected to the rail vehicle by the coupling elements. This measure can be used to ensure that, when the at least one passenger boards and disembarks, the vehicle experiences little to no heeling or rocking.

According to a further aspect or a further preferred embodiment of the present invention, the at least one vehicle has a control device and the control device enables the at least one passenger to actively influence the driving behavior of the relevant vehicle. The control device can have corresponding actuating elements on the vehicle, which simulate, for example, a helm of a boat, as a result of which the at least one passenger can take on the role of a helmsman or steersman at times or in sections during the vehicle's journey and can actively control the driving behavior of the relevant vehicle by using corresponding inputs to the actuators.

According to a further preferred embodiment of the present invention, the control device has an interface which can be connected to a personal mobile terminal of the passenger, preferably wirelessly, and the passenger can use their personal mobile terminal to actively influence the driving behavior of the vehicle. In particular, it is preferred if the amusement ride provides a ride-specific app for the passenger's personal mobile terminal, which the passenger can load and install on their personal mobile terminal, preferably before riding the amusement ride. The ride-specific app can be downloaded from app stores for different operating system platforms and, with appropriate pricing, can be used economically.

The ride-specific app can be run while riding the amusement ride and the passenger's control commands can be transmitted from the personal mobile terminal to the control device via the interface. The passenger's control commands can be generated, for example, by a movement, for example a tilting of the personal mobile terminal, or by manual inputs.

In this context, the driving behavior of the vehicle can be understood to mean the speed, the direction of travel, rotation about the vertical axis of the vehicle, longitudinal, and/or transverse movement, i.e., rocking or rolling. Rotation about the vertical axis of the vehicle and longitudinal and/or transverse movement of the boat can be generated by the at least one actuator or the at least one control element of the rotational joint of the connecting device.

According to a further advantageous feature of the present invention, the rail guide has at least one switch. In particular, it is preferred if the rail guide has a dead end adjacent to a switch along the route; this allows novel effects to be realized. For example, the at least one vehicle can drive toward the dead end of the rail guide at high speed and abruptly stop before the end. When the vehicle brakes suddenly, the vehicle can make a superimposed movement about the transverse axis. Accompanying this, animations or performances can be shown by presentation means and at the same time the switch can be switched without the at least one passenger noticing any-thing, preferably in secret below the water surface of the body of water. The vehicle can then continue driving from the dead end in the opposite direction of travel.

To give a specific example, there may be an obstacle at the dead end, or, in-stead of the obstacle, the rail guide may be bent and visibly end in the air. In addition, a human or fictional character could be seated on the rail guide carrying out welding work on the defective or broken rail guide. In this case, the at least one passenger pays a lot of attention to the scenery and does not notice the change in the vehicle's direction of travel as such. As soon as the suspense begins to diffuse, the at least one passenger can be put into another driving situation that requires getting used to, and the arc of suspense is maintained while riding the amusement ride.

If the vehicle has the rail vehicle and the boat, it may be preferred for the control element to cause the boat to rotate about the vertical axis of the rail vehicle in a superimposed manner by means of the rotational joint in the dead end section so that the passengers in the following driving situation are directed in the direction of travel as intended.

According to a further aspect of the present invention or a development of the present invention, at least one effect vehicle is provided which can travel on the rail guide. The at least one effect vehicle can move autonomously independently of the at least one vehicle for transporting at least one passenger, it being possible for the effect vehicle to be used to generate a large number of effects. For example, the effect vehicle can represent a pursuing vehicle, a monster, a sea monster, a pirate ship, or the like. The effect vehicle can also be a "launch torpedo" or a "booster".

The "launch torpedo" or the "booster" is an autonomous rail vehicle that has a power-trimmed drive. The "launch torpedo" or the "booster" can be coupled with the at least one vehicle accommodating a passenger and accelerate said vehicle particularly strongly. The "launch torpedo" or the "booster" can be coupled with the at least one vehicle and accelerate it, accompanied by special effects such as engine noise, steam, jets of water, or the like.

According to an advantageous development of the present invention, the at least one effect vehicle can be guided onto the route and/or away from the route by means of the at least one switch. The at least one effect vehicle can be guided from a starting position onto a section of the route and interact with the at least one vehicle accommodating a passenger in this section. The effect vehicle can then be guided away from the route and drive back to the starting position via a "bypass" where it waits for another vehicle. The effect vehicle can also be randomly controlled or sent onto the route for interaction every xth passage of the at least one vehicle.

The effect vehicle can, for example, represent an enemy attack by pirates with a pursuit in the corresponding section of the route. Alternatively, the effect vehicle can accelerate the relevant vehicle in the corresponding section as a "launch torpedo" or "booster" and then drive back to the starting position to wait for a following vehicle.

In the event that the amusement ride is designed as a water amusement ride having a body of water, it may be preferred that the effect vehicle is configured to be located completely below the water surface of the body of water. This ensures that the effect vehicle cannot be seen by the passengers of the amusement ride either in the starting position or on the route and thus remains hidden.

According to a preferred development, the effect vehicle can have at least one control element for actuating objects and/or for animating or creating effects. For example, the control element can raise or lower a monster. In particular, when the effect vehicle is located completely below the water surface, the object or the monster can suddenly emerge out of the body of water, as a result of which a surprise effect that captivates the at least one passenger can be produced. The at least one control element can also operate cannons or water cannons, for example, in order to simulate an attack by an opponent.

According to a development of the effect vehicle, the effect vehicle can be occupied by people. The people are preferably employees of the amusement ride opera-tor and can represent poaching pirates, a wild mob, monsters, or similar and can interact with the passengers. The characters can also operate cannons or water cannons to realistically simulate an attack by an opponent.

In addition, it has proven to be advantageous if the at least one effect vehicle has actuating means with which the effect vehicle can actuate the coupling device and/or the lockable coupling elements of the at least one vehicle, i.e., opening and/or closing. For example, the effect vehicle can actuate the coupling device, as a result of which the at least one active drive is decoupled and the corresponding vehicle can only be driven by the effect vehicle.

It can also be advantageous if the lockable coupling elements are actuated by the effect vehicle, as a result of which the location of the boat relative to the rail vehicle is fixed and the boat is held in a safe position, for example for strong acceleration.

According to a further aspect or a preferred development of the present invention, the route has a section with a basin, it being possible to raise and lower a water level in the basin in a controlled manner. The water level in the basin can be raised abruptly or quickly by supplying water, for example by pumping in the bottom of the basin or by a gush of water (e.g., a waterfall). Using time control or when a water level is exceeded, the water can be drained and the water level in the basin can be lowered. Abrupt draining of the water can be accomplished, for example, by a lock gate through which the vehicle can also travel.

It may be preferable for the at least one vehicle to first drive into the basin and then the water level to be raised in a controlled manner, with the boat immediately following the water level at the same time. By draining the water from the basin, the journey along the route can be continued abruptly, it being possible to convey to the passenger the feeling that the vehicle is being swept along by the draining water.

According to a further advantageous embodiment of the present invention, the rail guide has at least one rocker, the rocker being pivotable about an axis, preferably transversely to the direction of travel. With reference to DE 10 2014 101 007 A1, DE 10 2016 109 373 A1, or DE 10 2013 222 910 A1, the rocker can comprise a section of the rail guide and the at least one vehicle can drive onto the section of the rail guide with the rocker. A movement can then be transferred to the vehicle by a pivoting movement about the axis of the rocker and the vehicle can then travel either by means of the active drive or passively driven by the rocker, following the route in the direction of travel.

According to a further preferred embodiment of the present invention, a section of the route has the basin and the at least one rocker. In particular, it is preferred if the at least one rocker is arranged in sections in the basin and forms part of a basin edge. When the water level in the basin is raised in a controlled manner, the vehicle can drive onto the section of the rail guide of the rocker and then the corresponding vehicle can be "lifted" over the basin edge by the pivoting movement of the rocker. Together with a gush of water, the journey can then be continued over the remaining extent of the route.

A further and final aspect of the present invention relates to a method for operating an amusement ride according to the invention.

An exemplary embodiment of an amusement ride according to the invention, in particular a water amusement ride, and three developments are described in detail below with reference to the accompanying drawings, in which.

Identical or functionally identical components are identified below with the same reference symbols. For the sake of clarity, not all parts that are the same or functionally the same are provided with a reference number in the individual figures.

Figure 1:
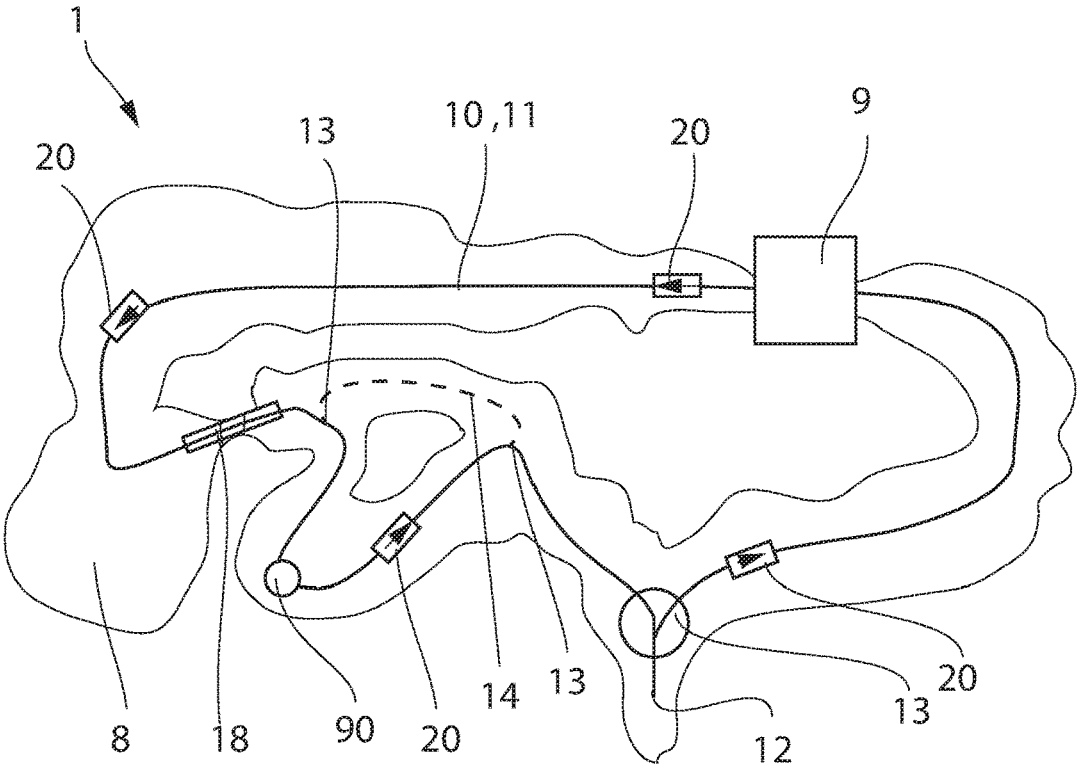
FIG. 1 is a greatly simplified representation of an amusement ride having a rail guide with at least one vehicle which can accommodate at least one passenger and which can travel, guided on the rail guide, a route in a direction of travel.

FIG. 1 is a greatly simplified view of an amusement ride 1 from above. The amusement ride 1 is a water amusement ride which has a natural or artificial body of water 5. The artificial body of water 5 can have one or more lakes, streams, or whitewater courses. The amusement ride 1 also has a rail guide 10, which can have at least one guide rail (not shown), preferably two parallel and spaced apart guide rails (also not shown). The rail guide 10 predefines a route 11 for at least one vehicle 20, the at least one vehicle 20 being able to travel, guided on the rail guide 10, the route 11 in a direction of travel. The direction of travel is shown in FIG. 1 by means of arrows in the vehicles 20, the direction of travel corresponding to a main direction of travel, which typically follows a gradient in the body of water 5 and describes a direction of movement from a starting point in a station 9 to an end point, possibly also in the station 9.

The route 11 can—as shown in the exemplary embodiment illustrated—be a closed circular path and a plurality of vehicles 20 can circulate along the route 11 one behind the other, as a result of which the present amusement ride 1 is designed for a high throughput of passengers and continuous operation.

The rail guide 10 or the route 11 can have a large number of sharp bends, the sharp bends being able to simulate a journey through a canyon or white water and it being possible for rocks, flotsam, islands, or other objects to be arranged in the body of water 5 beyond the route 11. Due to the sharp bends, the vehicle 20 can meander around the objects along the route 11, simulating dangerous situations and building up an arc of suspense by means of multiple abrupt changes of direction.

Straight sections of the route 11 can be used to execute quick descents or to accelerate the vehicle 20—as will be described in detail below.

Figure 2:
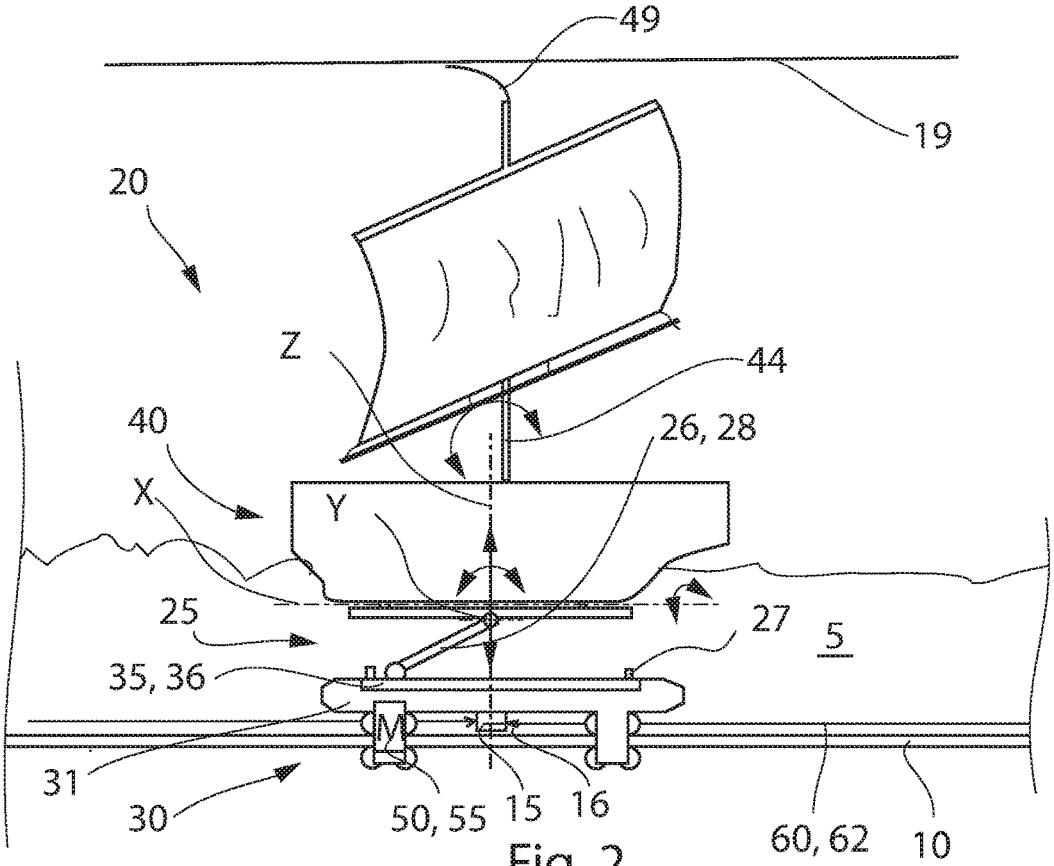
FIG. 2 is a schematic side view of a vehicle of the amusement ride according to FIG. 1.
Figure 3:
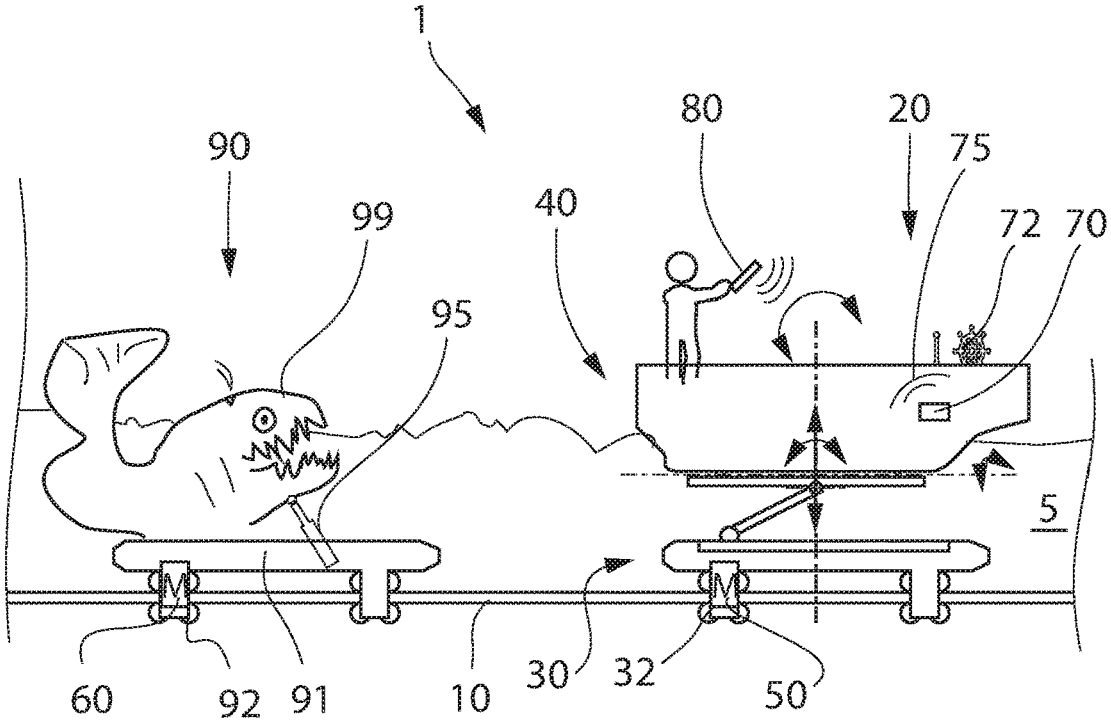
FIG. 3 is a schematic side view of an effect vehicle and of a vehicle of the amusement ride according to FIGS. 1 and 2.

The at least one vehicle 20, which is shown in detail in FIGS. 2 and 3 by way of example, is configured to accommodate at least one passenger, preferably a plurality of passengers. The passengers can board the vehicle 20 at an entrance in the station 9 and, after traveling the route and completing the ride experience, the passengers can preferably leave the vehicle 20 again in the station 9 via an exit.

The passengers are seated in the vehicle as intended, it being possible for a plurality of rows of seats to be arranged in the vehicle and for each row to have a plurality of seats arranged side by side.

With reference to FIG. 2, it can be seen that the vehicle 20 comprises a rail vehicle 30 and a boat 40, the boat 40 being firmly connected to the rail vehicle 30 by means of a connecting device 25.

The rail vehicle 30 has an undercarriage 31 with running and support wheels 32 which are only indicated in the drawings and which support the rail vehicle 30 on a guide rail of the rail guide 10. The running and support wheels 32 preferably embrace the guide rail, as a result of which the rail vehicle 30 is securely held on the rail guide 10. The rail vehicle 30 can have two or more axles with running wheels and support wheels 32, in which case each axle can be held so that it can rotate about a center of rotation relative to the rail vehicle 30 and in this way particularly tight bends can be negotiated.

The boat 40 has the seat(s) for the passenger(s) and is a buoyant body that can float freely in the body of water 5 even with its maximum allowable load.

The connecting device 25 is shown in an extremely simplified manner in the accompanying figures and comprises a plurality of articulated rods 28 which mechanically firmly connect the rail vehicle 30 and the boat 40 to one another. The connecting device 25 enables the boat 40 to perform typical water movements relative to the rail vehicle 30, thus allowing said boat to float above the rail vehicle 30 and also allowing limited transverse and/or longitudinal movements of the boat 40 relative to the rail vehicle 30 when the boat 40 is afloat. The transverse movement takes place about a transverse axis Y and the longitudinal movement takes place about a longitudinal axis X. The resulting movements are indicated by double arrows in FIGS. 2 and 3. This mobility of the boat 40 relative to the rail vehicle 30 allows the boat 40 to roll, tilt, or rock and thus convey the feeling of a boat ride that is as realistic as possible.

However, the connecting device 25 restricts the longitudinal and transverse movements of the boat 40 to a predetermined range in order to ensure safe operation of the amusement ride 1 at all times and to protect the boat 40 from capsizing and from pronounced heeling.

Furthermore, the connecting device 25 can have one or more actuators 26 which can impart a longitudinal or transverse movement on the boat 40. The actuator 26 can be activated in synchronization with animations or performances that can be presented to the passengers along the route of the amusement ride 1, as a result of which a movement of the boat 40 by the at least one actuator 26 is coordinated with the animation or performance.

Furthermore, FIG. 2 shows that the vehicle 20 has a rotational joint 35 which allows the boat 40 to be rotated about a vertical axis Z of the rail vehicle 30. The boat 40 can be rotated about the vertical axis Z of the rail vehicle 30 by means of a corresponding control element 36.

Furthermore, lockable coupling elements 27 can be provided, by means of which the position and/or location of the boat 40 relative to the rail vehicle 30 can be fixed. In particular, the coupling elements 27 can fix the location and/or the position of the boat 40 in the station 9 so that the passengers can board and disembark the boat 40 without the boat heeling or only heeling to a limited extent.

The amusement ride 1 can also have at least one active drive 50; in the exemplary embodiment shown in FIG. 2, the amusement ride 1 has a first active drive 50 and a second active drive 60.

The first active drive 50 is fixed to the vehicle 20 or fixed to the rail vehicle 30 and comprises a motor 55 of any design. The motor 55 is preferably an electric motor 55 which is characterized in that it drives the vehicle 20 substantially noiselessly and the passenger does not consciously perceive the active drive 50 of the vehicle 20.

The second active drive 60 can be operated independently of the first active drive 50 and, in the exemplary embodiment shown, is a cable drive 62 which is configured to pull the vehicle 20 along the route 11 at least in sections.

The vehicle 20 also has a coupling device 15, and the coupling device 15 can comprise clamps 16 and couplings, thus allowing the vehicle 20 to switch between the active drives 50, 60 at any time. The coupling device 15 can, for example, use the clamp 16 to couple the vehicle 20 to the second active drive 60, i.e., the cable drive 62, which is designed, for example, to pull the vehicle over a longer distance with the aid of a plurality of deflection rollers at a high speed, but also, if necessary, at a constant speed. In this case, the coupling device 15 can decouple the first active drive 50.

A plurality of cable drives 62 with different speeds can also be provided, with the coupling device 15 having a plurality of clamps for coupling. The active drives 50, 60 can also run in different directions, which makes it possible for the vehicle to drive at least in sections along the route 11 counter to the direction of travel.

In the present exemplary embodiment, the first active drive 50 is firmly connected to the vehicle 20. The drive 50 can be supplied with energy by an energy store in the vehicle 20. If electrical energy is required to operate the vehicle 20, the electrical energy can be provided by a battery. It is also conceivable for the electrical energy to be transmitted inductively or by cable to the vehicle 20 along the route 11. Capacitors or supercapacitors, caps or supercaps, and/or fuel cells can also be used in order to supply the vehicle 20 with electrical energy at least temporarily.

As can be seen from FIG. 2, the vehicle 20 or the boat 40 can have decorative elements such as a mast 44 and a sail 45, but also nautical instruments (not shown). The mast protrudes from the boat 40 and has a wiper at its free end 46 which is designed to contact an electrical conductor which is arranged above the route 11.

To personalize the ride experience for the passenger, the vehicle 20 can have a control device 70 which allows the passenger to influence the driving behavior of the vehicle 20 while riding on the vehicle 20. For example, controls 72 can be provided on the vehicle 20 or on the boat 40 so that the passenger can slip into the role of a captain or a steersman in order to actively influence the driving behavior of the vehicle 20 for a limited time or in sections by using inputs. For example, the passenger can accelerate or brake the vehicle 20, drive it backward or forward, or specifically deflect the boat 40 in the longitudinal and/or transverse direction by means of the at least one actuator 26.

An interactive waiting area can be provided in the station 9, in particular in the entrance area and thus before riding on the at least one vehicle 20 of the amusement ride 1. Games, quizzes, and other competitions can be held in the interactive waiting area and the results can be evaluated. Based on the result, the seats and roles of the passengers during the ride can be allocated for the journey on the amusement ride 1.

Such a role can be, for example, the commander, gunner, helmsman, steersman, captain, or similar. Accessories such as a captain's hat, a control, or terminal for the control unit or similar can also be issued. The control device 70 can have an interface 75 which is designed to receive control signals, preferably wirelessly. The passenger can, for example, install software or an app on their personal terminal 80, which evaluates the corresponding inputs by the passenger and sends control signals to the control device 70 via the interface 75.

FIG. 3 shows a schematic detail of FIG. 1, in which an effect vehicle 90 follows the vehicle 20 in a section of the route 11.

The effect vehicle 90 is preferably an autonomously driving vehicle with an undercarriage 91 and rotatingly mounted running and support wheels 92 which support the effect vehicle 90 on the rail guide 10. The effect vehicle 90 preferably or predominantly travels completely below the water surface of the body of water 8 and is therefore protected from the passenger's view. The effect vehicle 90 can be driven by a corresponding active drive 50, 60.

The effect vehicle 90 can be guided onto the route 11 from a starting position by means of a switch 13 and can leave the route 11 by means of a second switch 13 and be guided back to the starting position via a bypass 14. The bypass 14 is shown in FIG. 1 by a dashed line.

The effect vehicle 90 is configured to interact with the vehicle 20 in a section between the two switches and can have a control element 95 for actuating objects and/or for animating or creating effects. For example, the control element can raise or lower a monster 99. In particular, if the effect vehicle 90 is located completely below the water surface, the monster 99 can emerge suddenly from the body of water 5. The at least one control element 95 can also actuate cannons or water cannons in order to simulate an attack by a pirate ship, for example. A development that is not shown can have an effect vehicle 90 which, for example, accelerates the vehicle 20 to a particularly high speed when traveling in a straight route section. For this purpose, the effect vehicle 90—as already described above in a different context—can be guided onto and away from the route 11. The effect vehicle 90 is a power-trimmed vehicle which can be pushed by the vehicle 20. The effect vehicle 90 can be used as a "booster" or "launch torpedo" with the appropriate decoration to push the vehicle 20 and then be decoupled from it. For this purpose, the effect vehicle 90 can be positioned either behind, in front of, or to the side of the vehicle 20. It is also possible to use a plurality of effect vehicles 90. The effect vehicle 90 can have actuating means with which the effect vehicle 90 can actuate the coupling device 15 and/or the lockable coupling elements 27 of the at least one vehicle 20. For example, the effect vehicle 90 can actuate the coupling device 15, whereby the active drives 50, 60 are decoupled so that the boat 40 is fixed in location and position relative to the rail vehicle 30 by the lockable coupling elements 27 until the speed is reduced again.

The vehicle 20 can be braked in the body of water 5 by means of a "big splash". For this purpose, the rail guide 10 initially runs close to the water surface of the body of water 5 and then submerges, as a result of which the boat 40 dips into the water, causing a "splashdown" with a corresponding spray.

Figure 4:
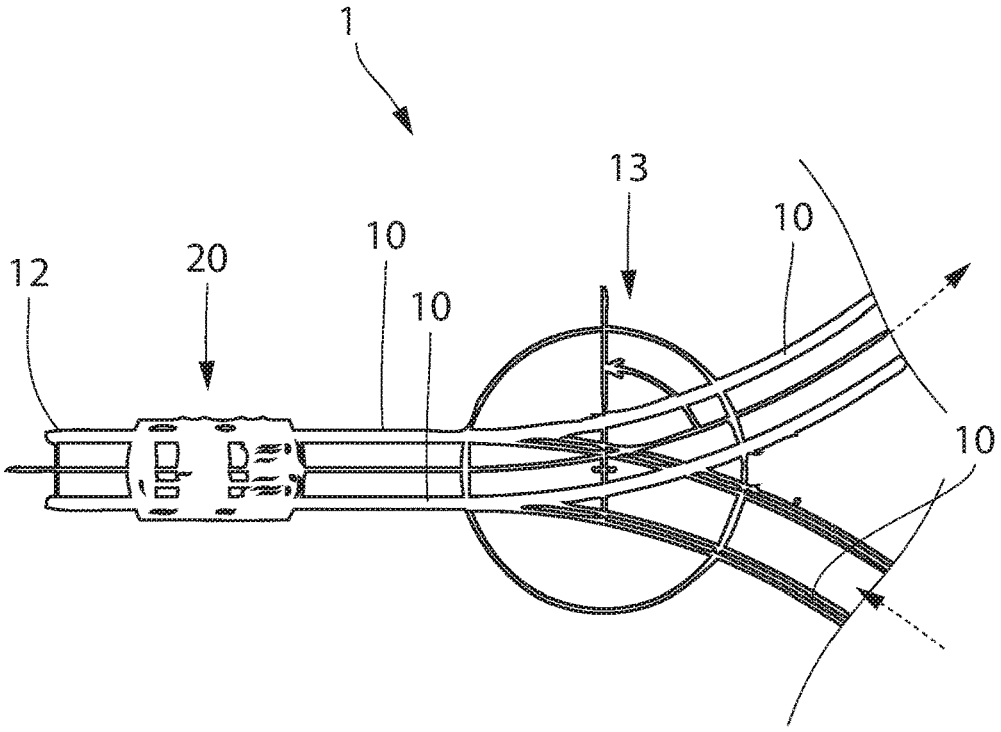
FIG. 4 is a schematic representation of a route section with a dead end and a switch.

FIG. 4 shows that the route 11 can have a dead end 12. Animations or performances can be shown to the passenger at the dead end 12, while the switch 13 is switched below the water surface of the body of water 5 and the vehicle 20 can continue driving along the route in the opposite direction of travel.

As described above, the body of water 5 can have lakes that can be formed by a basin 8 along the route 11. The basin 8 has a peripheral basin edge 8' as well as means for raising and lowering a water level in the basin 8 in a controlled manner.

Figure 5:
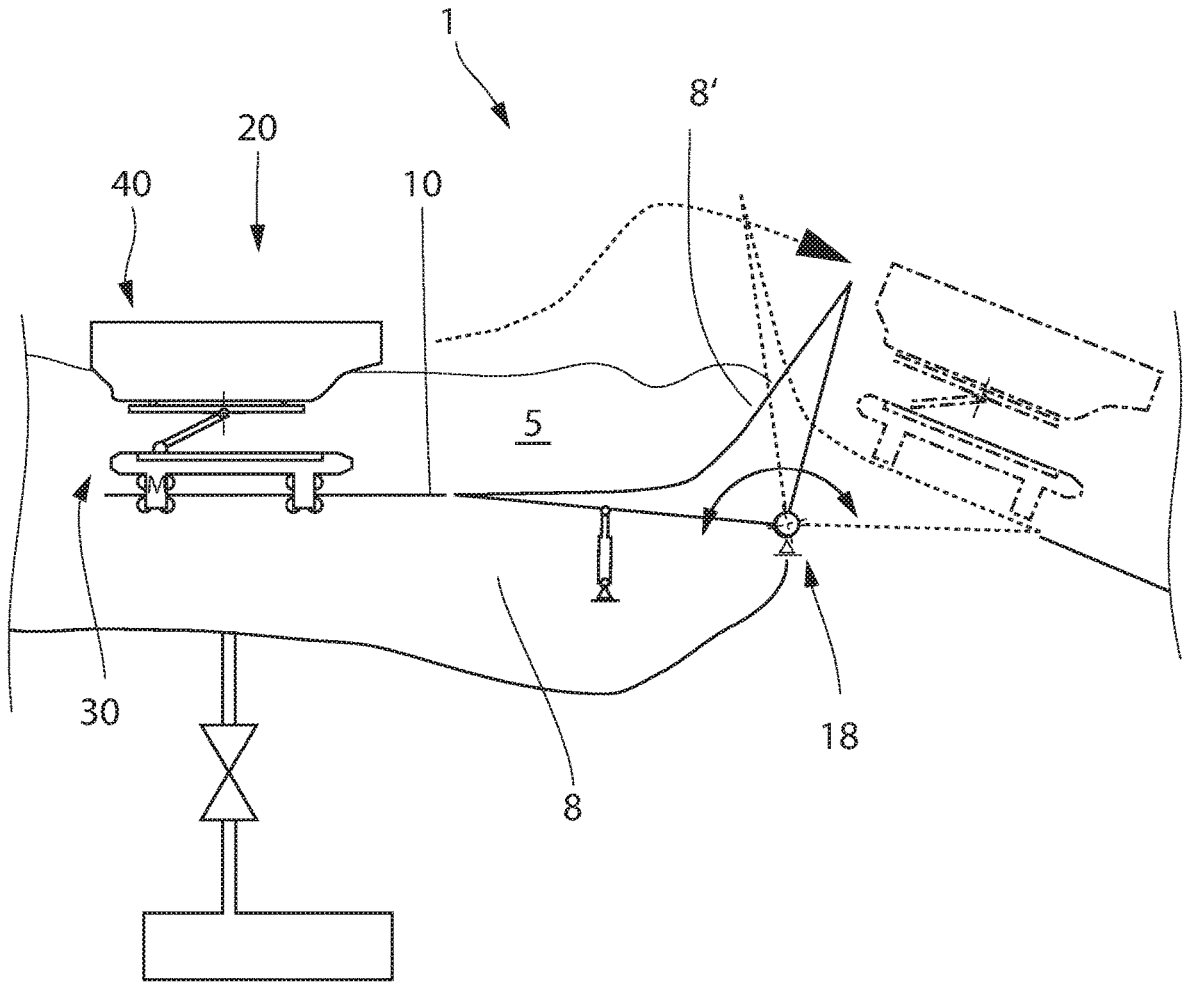
FIG. 5 is a schematic representation of a route section with a basin and a rocker.

In FIG. 5 these means are represented symbolically by a valve and a water reservoir in the area of a bottom of the basin 8, but, in the context of this invention, the water level in the basin 8 can be raised in any arbitrary way. For example, it is possible to raise the water level in the basin 8 by means of a gushing waterfall or to raise and lower it by opening a water-supplying sluice. For example, a dam breach can be represented in this way.

When the water level in the basin rises and falls, the boat 40 can float freely relative to the rail vehicle and thus follows the water level. The route 11 leads to the basin edge 8' and a rocker 18 with a movable section of the rail guide 10 is arranged in the area of the edge basin edge 8'. The section of the rail guide 10 of the rocker 18 can be pivoted about at least one axis, preferably transversely to the rail guide 10, by suitable control elements. To drive the vehicle 20 "over" the basin edge 8', the vehicle 20 first drives onto the rocker 18. The rocker 18 is then pivoted about the axis and the vehicle 20 can move off the rocker 18 and continue traveling along the route 11 normally. In FIG. 5, the rocker 18 and the vehicle 20 are shown in dashed lines after the rocker 18 has been pivoted. The dashed arrow in FIG. 5 symbolizes the travel path of vehicle 20 over the rocker 18.

LIST OF REFERENCE NUMERALS

1 Amusement ride.
5 Body of water.
8 Basin
8' Basin edge
9 Station
10 Rail guide.
11 Route.
12 End
13 Switch
14 Bypass
15 Coupling device
16 Clamp:
18 Rocker
19 Electrical conductor
20 Vehicle
25 Connecting device
26 Actuator
27 Coupling elements
28 Articulated rods
30 Rail vehicle
31 Undercarriage.
32 Support wheels
35 Rotational joint
36 Actuator.
40 Boat
44 Mast
45 Sail
50 Drive
55 Motor
60 Drive
62 Cable drive
70 Control device
72 Controls
75 Interface
80 Terminal
90 Effect vehicle
91 Undercarriage
92 Support wheels
95 Control element
99 Sea monster
X Longitudinal axis
Y Transverse axis
Z Vertical axis

The invention claimed is:

1. An amusement ride (1), in particular a water amusement ride, having at least one rail guide (10) with at least one vehicle (20), preferably at least two vehicles, which accommodate/s at least one passenger and which can travel, guided on the rail guide (10), a route (11) in a direction of travel, characterized in that the at least one vehicle (20) or one of the at least two vehicles (20) can be moved by an active drive (50, 60), counter to the direction of travel, at least in sections of the route (11), characterized in that the vehicle (20) comprises a rail vehicle (30) and a buoyant boat (40) for accommodating the at least one passenger, the boat (40) being coupled to the rail vehicle (30) by means of a connecting device (25) which allows the boat (40) to float above the rail vehicle (30), said connecting device (25) allowing at least one type of movement selected from the group consisting of a transverse movement, a longitudinal movement and a lifting movement of the boat (40) relative to the rail vehicle (30) when the boat (40) is afloat, and characterized in that the connecting device (25) comprises at least one actuator (26), said at least one actuator (26) being pivotally connected to the rail vehicle (30) and pivotally connected to the boat (40), the at least one actuator (26) allowing the boat (40) to perform the at least one type of movement selected from the group consisting of the transverse movement, the longitudinal movement and the lifting movement of the boat (40) relative to the rail vehicle (30).

2. The amusement ride (1) according to claim 1, characterized in that the rail guide (10) of the route (11) runs, at least in sections, in a body of water (5).

3. The amusement ride (1) according to claim 1, characterized in that the route (11) forms a closed loop, and the at least one vehicle (20) can be moved along the closed loop in the direction of travel.

4. The amusement ride (1) according to claim 1, characterized in that the body of water (5) flows at least along regions of the route (11) in the direction of travel, and in that the vehicle (20) can be passively driven along said regions of the route (11) by a current of the body of water (5).

5. The amusement ride (1) according to claim 1, characterized in that the at least one actuator (26) enables the boat (40), in the floating state, to be moved transversely and/or longitudinally in an angular range of ±50°relative to the rail vehicle (30).

6. The amusement ride (1) according to claim 1, characterized in that the connecting device (25) comprises articulated rods (28).

7. The amusement ride (1) according to claim 1, characterized in that lockable coupling elements (27) are provided, by means of which the position and/or location of the boat (40) relative to the rail vehicle (30) can be fixed.

8. The amusement ride (1) according to claim 1, characterized in that a rotational joint (35) is provided, by means of which the boat (40) can be rotated about a vertical axis (Z) relative to the rail vehicle (30).

9. The amusement ride (1) according to claim 1, characterized in that a control element (36) is provided, by means of which the boat (40) can be rotated about a vertical axis (Z) relative to the rail vehicle (30).

10. The amusement ride (1) according to claim 1, characterized in that a second active drive (60) is provided which can drive the at least one vehicle (20) independently of the first active drive (50).

11. The amusement ride (1) according to claim 1, characterized in that the vehicle (20) has at least one coupling device (15) by means of which at least one of the active drives (50, 60) can be coupled and/or decoupled.

12. The amusement ride (1) according to claim 1, characterized in that at least one coupling device (15) can switch between the first active drive (50) and the second active drive (60).

13. The amusement ride (1) according to claim 1, characterized in that the first active drive (50) and/or the second active drive (60) is a cable drive (62), a conveyor chain drive, a gear drive, a friction drive, a lantern gear drive, a linear synchronous drive, a linear induction drive, or a magnetic drive.

14. The amusement ride (1) according to claim 1, characterized in that at least one of the active drives (50, 60) is fixed to the vehicle.

15. The amusement ride (1) according to claim 1, characterized in that the vehicle (20) is supplied with electrical energy inductively, by cable, by means of a wiper (49), and/or by means of at least one battery, a supercapacitor, or a fuel cell.

16. The amusement ride (1) according to claim 1, characterized in that the vehicle (20) has a mast (44) with means for transmitting electrical energy.

17. The amusement ride (1) according to claim 1, characterized in that at least one electrical conductor (19) is arranged at least in sections over the route (11), and in that the means on the mast (44) contact the at least one electrical conductor (19) to transmit electrical energy.

18. The amusement ride (1) according to claim 1, characterized in that the route (11) has at least one section in which the vehicle (20) emerges completely or partially from the body of water.

19. The amusement ride (1) according to claim 1, characterized in that the vehicle (20) has a control device (70) and in that the control device (70) enables the at least one passenger to actively influence the driving behavior of the vehicle (20).

20. The amusement ride (1) according to claim 1, characterized in that the control device (70) has an interface (75) which can be connected to a personal mobile terminal (80) of the passenger, and in that the passenger can use their personal mobile terminal (80) to actively influence the driving behavior of the vehicle (20).

21. The amusement ride (1) according to claim 1, characterized in that the control device (70) allows the driving behavior of the vehicle (20) to be influenced for a limited time or in sections.

22. The amusement ride (1) according to claim 1, characterized in that the driving behavior relates to the speed, the direction of travel, rotation about the vertical axis, and the longitudinal and/or transverse mobility.

23. The amusement ride (1) according to claim 1, characterized in that the rail guide (10) has at least one switch (13).

24. The amusement ride (1) according to claim 1, characterized in that at least one effect vehicle (90) is provided, which can travel on the at least one rail guide (10).

25. An effect vehicle (90) for an amusement ride according to claim 24.

26. The amusement ride (1) according to claim 1, characterized in that the at least one effect vehicle (90) can be guided onto the route (11) and/or from the route (11) by means of the at least one switch (13).

27. The amusement ride (1) according to claim 1, characterized in that the at least one effect vehicle (90) is configured to be able to accelerate or push the at least one vehicle (20).

28. The amusement ride (1) according to one claim 1, characterized in that the effect vehicle (90) is configured to travel completely below a water surface of the body of water (5).

29. The amusement ride (1) according to claim 1, characterized in that the effect vehicle (90) has at least one control element for moving objects and/or animating effects.

30. The amusement ride (1) according to claim 1, characterized in that the effect vehicle (90) has actuating means which allow the effect vehicle (90) to actuate the coupling device (15) and/or lockable coupling elements (27).

31. The amusement ride (1) according to the preamble of claim 1, characterized in that a station (9) with a waiting area is provided, and in that, in the waiting area, at least one competition among the passengers is held and evaluated, and in that the passengers are assigned seats or functions in the at least one vehicle (20) depending on the result.

32. The amusement ride (1) according to the preamble of claim 1, characterized in that the route (11) has a section with a basin (8), it being possible to raise and lower a water level in the body of water (5) in the basin (8) in a controlled manner.

33. The amusement ride (1) according to claim 1, characterized in that the rail guide (10) has at least one rocker (18), the rocker (18) being pivotable about at least one axis, preferably transversely to the direction of travel.

34. The amusement ride (1) according to claim 32, characterized in that when a predetermined water level is reached in the basin (8), the vehicle (20) continues driving over the rocker (18) in the direction of travel.

35. A method for operating an amusement ride according to claim 1.

* * * * *